US008387329B2

(12) United States Patent
Stevens et al.

(10) Patent No.: US 8,387,329 B2
(45) Date of Patent: Mar. 5, 2013

(54) REBAR CAGE STIFFENER RING

(75) Inventors: Scott D. Stevens, Scotia, NY (US); Greg B. Stevens, Scotia, NY (US)

(73) Assignee: Dimension Fabricators, Inc., Glenville, NY (US)

( * ) Notice: Subject to any disclaimer, the term of this patent is extended or adjusted under 35 U.S.C. 154(b) by 0 days.

(21) Appl. No.: 13/116,307

(22) Filed: May 26, 2011

(65) Prior Publication Data

US 2012/0297719 A1 Nov. 29, 2012

(51) Int. Cl.
*E04C 5/065* (2006.01)

(52) U.S. Cl. ..... 52/649.8; 52/220.3; 52/649.3; 52/677

(58) Field of Classification Search ..... 52/649.8, 52/648.1, 649.1, 649.2, 649.4, 677, 687, 52/220.1, 220.8, 220.3, 649.3
See application file for complete search history.

(56) References Cited

U.S. PATENT DOCUMENTS

| | | | | | |
|---|---|---|---|---|---|
| 277,374 | A | * | 5/1883 | Stohm | 174/111 |
| 280,919 | A | * | 7/1883 | Shane | 174/24 |
| 289,165 | A | | 11/1883 | Strohm | |
| 354,892 | A | | 12/1886 | Du Bois | |
| 924,090 | A | * | 6/1909 | Moore | 52/649.8 |
| 1,096,685 | A | | 5/1914 | Cummings | |
| 1,248,049 | A | * | 11/1917 | Wunder | 52/220.3 |
| 1,310,597 | A | * | 7/1919 | Blaw | 138/153 |
| 1,485,811 | A | | 3/1924 | Pederson | |
| 1,817,437 | A | | 8/1931 | Hawkinson | |
| 3,476,868 | A | * | 11/1969 | Williams et al. | 174/43 |
| 3,694,989 | A | * | 10/1972 | Oliver et al. | 52/678 |
| 3,885,296 | A | * | 5/1975 | Stout | 29/433 |
| 4,463,538 | A | | 8/1984 | Dragunas | |
| 4,467,583 | A | | 8/1984 | Hasak | |
| 4,715,571 | A | * | 12/1987 | Soltow et al. | 248/68.1 |
| 4,833,857 | A | | 5/1989 | Wheeler | |
| 4,961,554 | A | * | 10/1990 | Smowton | 248/68.1 |
| 5,016,336 | A | * | 5/1991 | Barnett et al. | 29/281.5 |
| 5,027,478 | A | * | 7/1991 | Suhr | 24/16 R |
| 5,044,136 | A | * | 9/1991 | Liu | 52/252 |
| 5,615,852 | A | * | 4/1997 | Heidorn et al. | 248/74.5 |
| 5,836,130 | A | * | 11/1998 | Unruh et al. | 52/698 |
| 6,131,365 | A | * | 10/2000 | Crockett | 52/794.1 |
| 6,325,336 | B1 | * | 12/2001 | Coykendall | 248/68.1 |
| 6,543,731 | B1 | * | 4/2003 | Mercier | 248/62 |
| 6,552,270 | B1 | * | 4/2003 | Heacox | 174/71 R |
| 7,461,491 | B1 | * | 12/2008 | Sorkin | 52/685 |
| 7,500,644 | B2 | * | 3/2009 | Naudet et al. | 248/68.1 |
| 8,020,811 | B2 | * | 9/2011 | Nelson | 248/68.1 |
| 2009/0100784 | A1 | * | 4/2009 | Garza et al. | 52/686 |

FOREIGN PATENT DOCUMENTS

| | | | | |
|---|---|---|---|---|
| GB | 2229466 | A | | 9/1990 |
| JP | 01178671 | A | * | 7/1989 |

* cited by examiner

*Primary Examiner* — Brian Glessner
*Assistant Examiner* — Brent W Herring
(74) *Attorney, Agent, or Firm* — Hoffman Warnick LLC

(57) ABSTRACT

A stiffener ring, and associated method and program product. A stiffener ring is provided having a generally annular shape for supporting a rebar cage, including: a plurality of primary cutouts spaced about an exterior edge of the stiffener ring, wherein each primary cutout is configured to receive a transversely mounted steel bar; a plurality of secondary cutouts spaced about an edge of the stiffener ring, wherein each of the secondary cutouts is configured to received an instrumentation pipe; and a set of flow holes cut into the stiffener ring to facilitate a flow of concrete through the stiffener ring.

9 Claims, 7 Drawing Sheets

REBAR CAGE STIFFENER RING

BACKGROUND

The present invention relates to rebar cage assemblies for use in reinforced concrete structures, and more particularly relates to a system of engineered internal supports for supporting a rebar cage.

Concrete structures, such as columns and the like, are typically constructed with a steel bar (rebar) cage. The rebar cage is generally cylindrical in shape with circular spacer members that support transversely running steel bars. The particular specifications and dimensions of a given rebar cage can depend on any number of factors, including, e.g., the size of the concrete structure being built, the engineering requirements, soil conditions, wind loads, etc. Based on developments in excavating and drilling equipment, it is no longer unusual for a cage to be 60 or more feet long, ten or so feet in diameter, and weigh tens of thousands of pounds. U.S. Pat. No. 4,467,583 issued to Hasak on Aug. 28, 1984, which is hereby incorporated by reference, describes such a structure (referred to therein as a "basket").

In a typical application, the rebar cage is custom fabricated off-premises and then transported to the construction site. Because of the height, weight and size, most rebar cages are manufactured and transported lying on their sides. At the time of installation, the cage is brought upright, or "tripped" and then placed in position, e.g., in a form or a drilled shaft, after which concrete is placed to create the reinforced concrete structure.

One of the challenges in manufacturing rebar cages is to ensure structural and dimensional stability is maintained while the cage is being transported, tripped, and set in place. A poorly fabricated or inadequately supported cage can become unstable under its own weight and collapse on itself, resulting in significant losses in time and money. Further, inaccurate or uncertain placement of components can result in structural capacity less than that required by codes or designers.

BRIEF SUMMARY

Disclosed is a substantially annular spacer member, referred to herein as a "stiffener ring" for use in a rebar cage. The stiffener ring enhances structural stability, accelerates fabrication of the cage and guarantees precise placement of the required structural elements.

In a first aspect, the invention provides a stiffener ring having a generally annular shape for supporting a rebar cage, comprising: a plurality of primary cutouts spaced about an exterior edge of the stiffener ring, wherein each primary cutout is configured to position and anchor a transversely mounted steel bar; a plurality of secondary cutouts spaced about an edge of the stiffener ring, wherein each of the secondary cutouts is configured to receive an instrumentation pipe; and a set of flow holes cut into the stiffener ring to facilitate a flow of concrete through the stiffener ring.

In a second aspect, the invention provides a rebar cage, comprising: a plurality of transversely mounted steel bars; and a plurality of stiffener rings that support the transversely mounted steel bars, wherein each stiffener ring includes: a plurality of primary cutouts spaced about an exterior edge of the stiffener ring, wherein each primary cutout locates and secures one of the transversely mounted steel bars mounted therein; and a plurality of secondary cutouts spaced about an edge of the stiffener ring, wherein each of the secondary cutouts locates and secures an instrumentation pipe mounted therein.

In a third aspect, the invention provides a method of fabricating a rebar cage, comprising: providing a stiffener ring that includes a plurality of primary cutouts spaced about an exterior edge of the stiffener ring; transversely mounting a plurality of steel bars in the primary cutouts; and fastening the steel bars within the primary cutouts using at least one of a wire, bolt and a clamp.

In a fourth aspect, the invention provides a program product stored on a computer readable storage medium for calculating a width and thickness of a stiffener ring for supporting a rebar cage, the program product comprising: program code for inputting a data pair comprising a cage weight and a cage diameter; program code for associating the data pair with one of a plurality of thickness values; program code for locating the data pair between a pair of boundary values, wherein each boundary value is associated with a width; and program code for outputting a resulting thickness and a resulting width.

BRIEF DESCRIPTION OF THE SEVERAL VIEWS OF THE DRAWINGS

These and other features of this invention will be more readily understood from the following detailed description of the various aspects of the invention taken in conjunction with the accompanying drawings.

Figure 1:
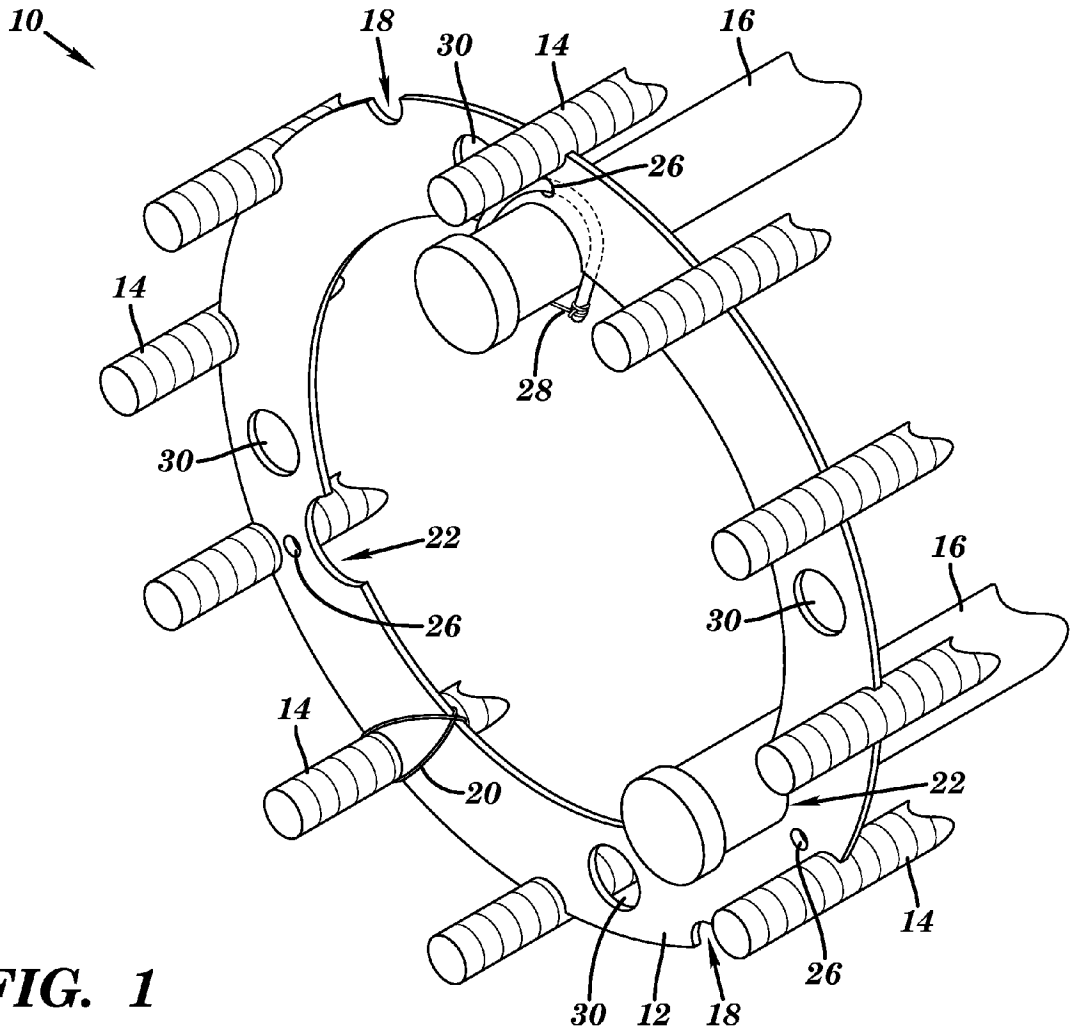
FIG. 1 depicts an isometric view of a portion of a rebar cage having a stiffener ring in accordance with embodiment of the present invention.

The drawings are merely schematic representations, not intended to portray specific parameters of the invention. The drawings are intended to depict only typical embodiments of the invention, and therefore should not be considered as limiting the scope of the invention. In the drawings, like reference numbering represents like elements.

DETAILED DESCRIPTION

FIG. 1 depicts an isometric view of an end portion of a rebar cage 10 suitable for use in constructing steel reinforced concrete columns and the like. As shown, rebar cage 10 includes a stiffener ring 12, which has a generally annular shape, and a plurality of transversely mounted steel bars 14 that are seated in a set of primary cutouts 18 about an external (i.e., "outer") edge of stiffener ring 12. In this embodiment, cutouts 18 comprise generally U-shaped openings that allow a portion of each steel bar's cross-sectional area to sit inside and a portion to sit outside the external edge of the stiffener ring 12. For example, in one illustrative embodiment, approximately half of the circular cross section of the rebar sits in the U-shaped cut-out, and the other half sits outside the opening. Each bar is held in place with a fastening device, e.g., a wire 20 that is manually wrapped around the stiffener ring 12 and bar 14. Alternatively, a bolt, clamp or other fastening device or system (e.g., welding) could be utilized.

It is noted that the rebar cage 10 depicted in FIG. 1 is shown with various elements not included in order to more easily describe the structure. For example, a few of the transversely mounted steel bars 14 are not shown, as well as internal support elements, outer hoops or spiral rebar, etc. Moreover, it is understood that rebar cage 10 would typically incorporate a plurality of stiffener rings 12 spaced, e.g., every several feet along the rebar cage 10.

Stiffener ring 12 also includes a set of secondary U-shaped cut-outs 22 that are adapted for receiving one or more instrumentation pipes 16. Instrumentation pipes 16 are utilized on site as a conduit through which instrumentation can be inserted to test the integrity, homogeneity and uniformity of the structure as it has been constructed. In this embodiment, the secondary U-shaped cut-outs 22 are larger than the primary cutouts 18. As shown, the instrumentation pipes 16 are mounted in U-shaped cutouts 22 on the internal edge of the stiffener ring 12. However, it is understood that the instrumentation pipes 16 could be mounted on the external edge along with the steel bars 14. Adjacent each instrumentation pipe cutout 22 is a mounting hole 26 for installing a clamp that can secure the instrumentation pipe 16. For example, a U-bolt 28 can be inserted through hole 26 to surround the pipe 16. A clamping device (e.g., wire, plate, rod, bolt, etc.) can then be attached to the U-bolt 28 to clamp the pipe 16 in place within the U-bolt 28. Correct placement of instrumentation piping within cage 10 is essential for proper data collection and evaluation of structural capacities. A further description of this is provided below with reference to FIG. 5.

Also included in stiffener ring 12 is a plurality of flow holes 30. Flow holes 30 reduce the weight of the fabricated stiffener ring 12, and also allow the concrete to flow more evenly through and around the stiffener ring 12. As concrete is typically pumped into a form around the rebar cage 10, flow holes 30 help ensure that during the pour the concrete completely envelopes the entire stiffener ring 12. Flow holes 30 may also allow the concrete to be pumped faster.

Figure 2:
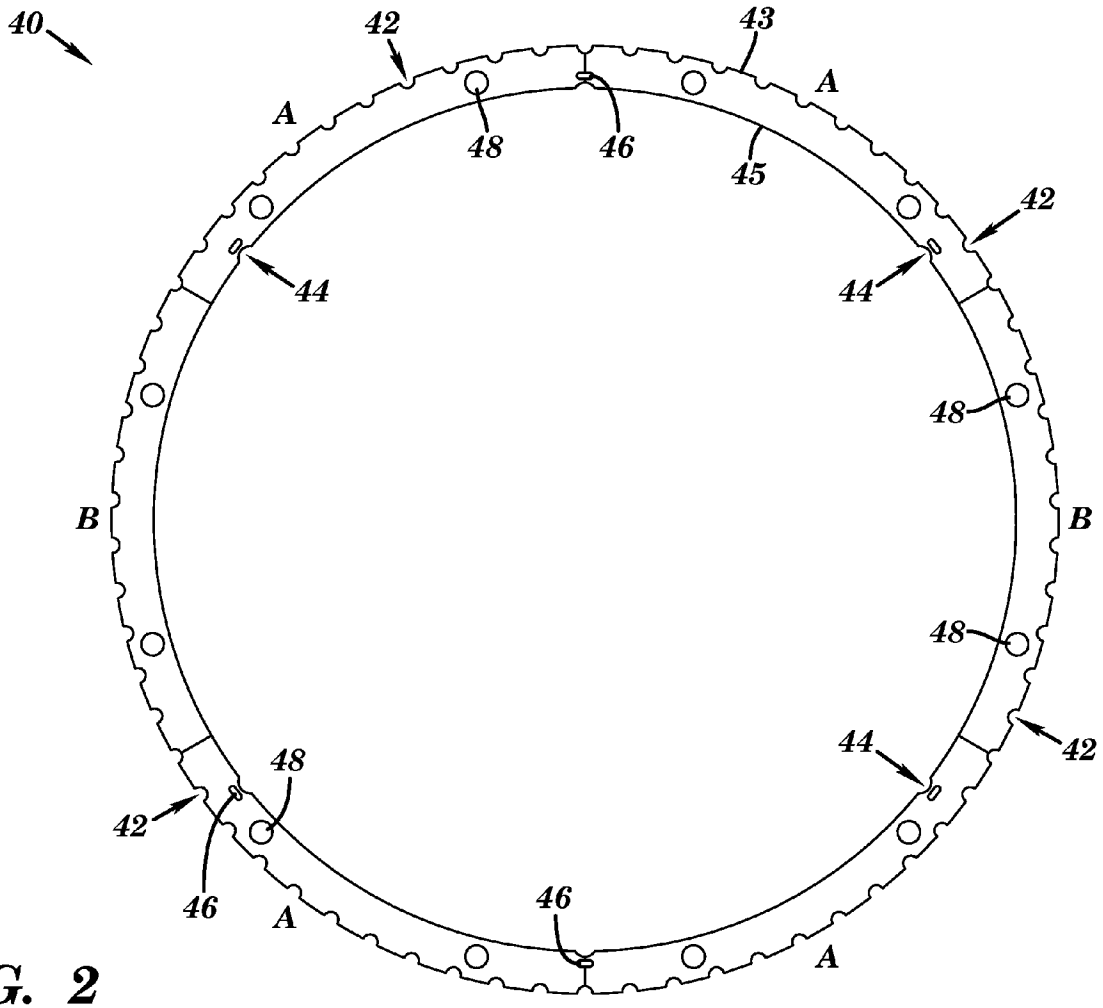
FIG. 2 depicts a stiffener ring in accordance with an embodiment of the present invention.

FIG. 2 depicts a plan view of a further illustrative embodiment of a stiffener ring 40. As described above, stiffener ring 40 includes: a plurality of primary U-shaped cutouts 42 along the external edge 43 for receiving and accurately radially positioning transversely mounted steel bars; a plurality of secondary U-shaped cutouts 44 along an internal edge 45 for receiving and accurately positioning transversely mounted instrumentation pipes; a plurality of mounting holes 46 located adjacent each of the plurality of secondary U-shaped cutouts 44 for securing instrumentation pipes; and a plurality of flow holes 48.

In this embodiment, stiffener ring 40 is fabricated from a plurality of segments, including four identical A segments and two identical B segments. Once each segment is cut, e.g., from a sheet of steel, the segments can be affixed, e.g., welded, bolted, etc., together to form the stiffener ring 40. By fabricating the stiffener ring 40 using segmented sections, multiple segments can be cut from a relatively small steel sheet of material, as opposed to a sheet large enough to accommodate the entire stiffener ring 40. Significant efficiencies are thus achieved in the amount of steel required and waste created, resulting in considerable cost savings. Nonetheless, it is understood that stiffener ring 40 could be fabricated as a single unitary piece of material.

Figure 3:
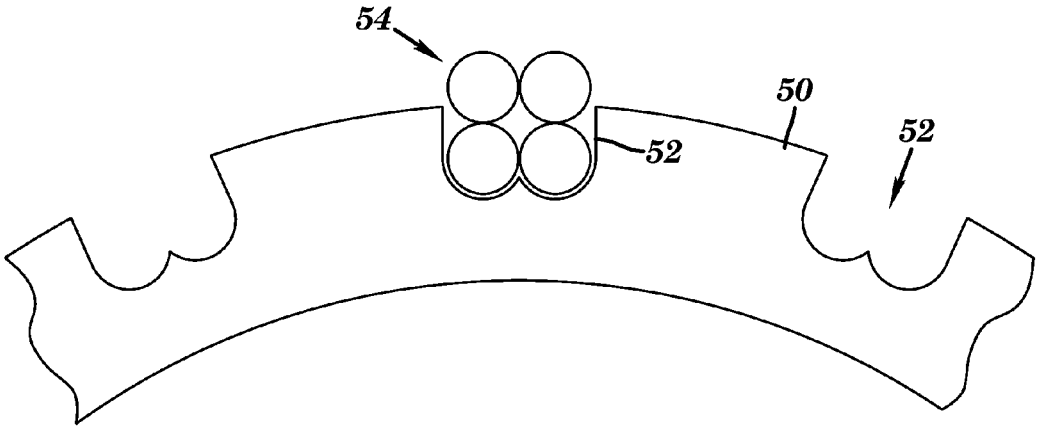
FIG. 3 depicts a portion of a stiffener ring having a double U-shaped cut-out in accordance with an embodiment of the present invention.

FIG. 3 depicts an alternative embodiment in which stiffener ring 50 includes a double U-shaped cutout 52 that accommodates a bundle 54 of steel bars. In this case, bundle 54 includes four steel bars fastened together. It is understood that double U-shaped cutout 52 could accommodate other bundle configurations, e.g., a two-bar bundle, a three bar bundle, a five bar bundle, etc. In addition, a triple or quadruple U-shaped cutout could be utilized to accommodate larger bundle configurations. Prior to development of this system, a variety of crude or inaccurate means have been employed to position and affix multiple bars, frequently resulting in varying geometries and structural capacities less than design requirements.

Figure 4:
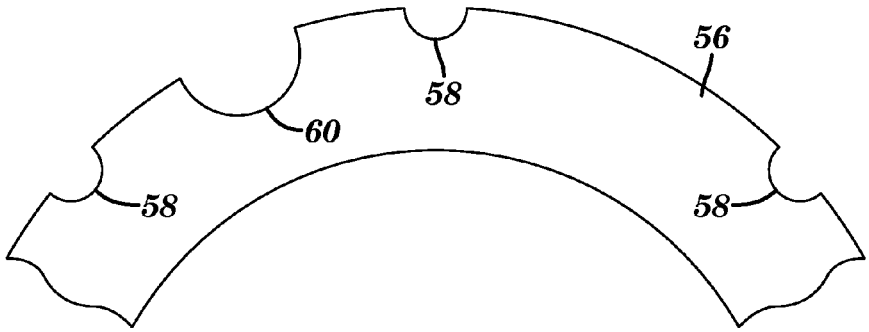
FIG. 4 depicts a portion of a stiffener ring having instrumentation pipe cutouts on the exterior edge in accordance with an embodiment of the present invention.

FIG. 4 depicts a stiffener ring 56 in which the instrumentation pipe cutouts 60 (only one shown) is placed on the external edge of the stiffener ring 56, along with the steel bar cutouts 58.

Figure 5:
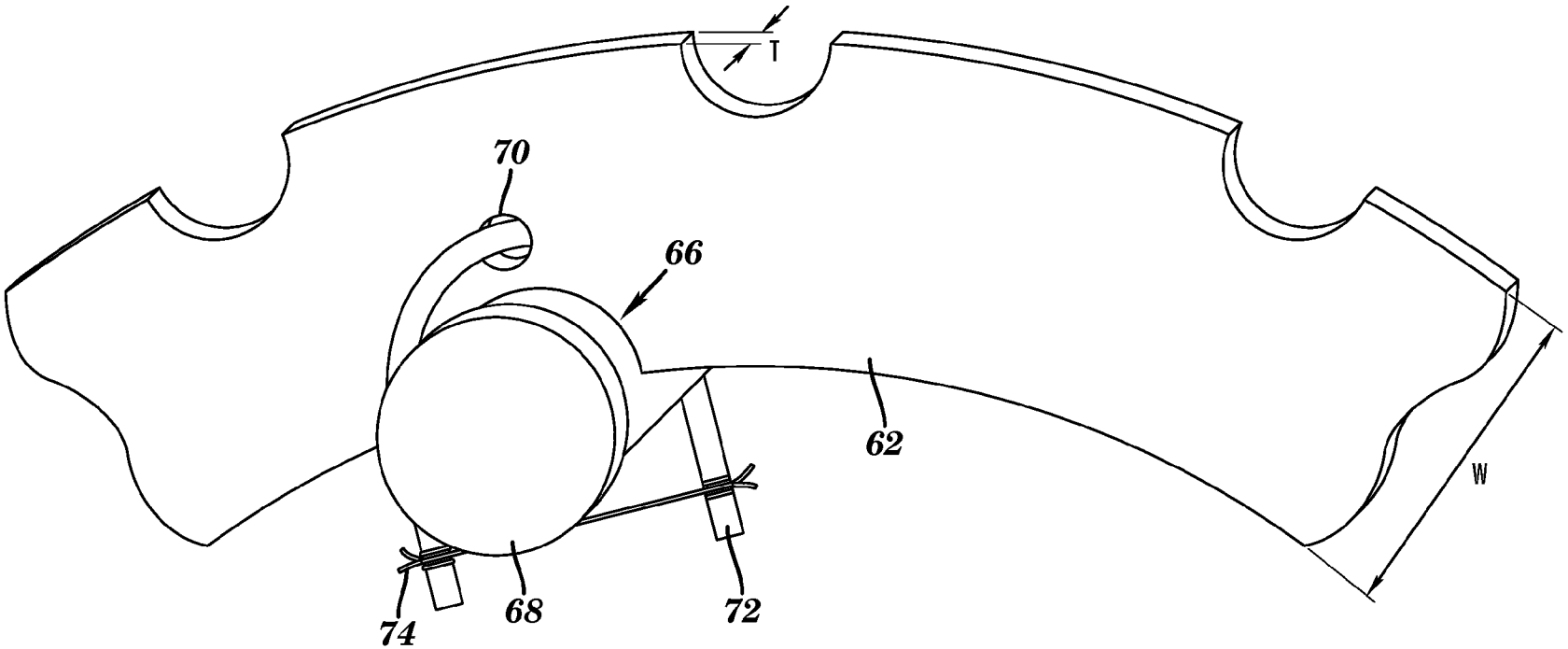
FIG. 5 depicts a portion of a stiffener ring having a mounting hole and U-bolt in accordance with an embodiment of the present invention.

FIG. 5 shows a stiffener ring 62 with a secured instrumentation pipe 68. In this embodiment, a U-bolt 72 is inserted through mounting hole 70 and around instrumentation pipe 68. A clamping device, e.g., a wire, bolt, plate, rod, etc., is affixed to the U-bolt 72 to form a clamp around the pipe 68. Also note that rather than a U-bolt 72, the clamp may include any structure that can pass through mounting hole 70 and secure the instrumentation pipe 68.

A further aspect of this disclosure includes automating the selection of design dimensions of the stiffener ring. Each stiffener ring has an overall diameter that is dictated by the specified cage diameter, e.g., if the cage specification is 10 feet in diameter, then the diameter of the stiffener ring needs to be approximately 10 feet in diameter. Accordingly, the thickness T of the ring, as well as the width W of the band that makes up the ring (as shown in FIG. 5), needs to be selected properly to ensure dimensional stability of the cage.

Figure 6:
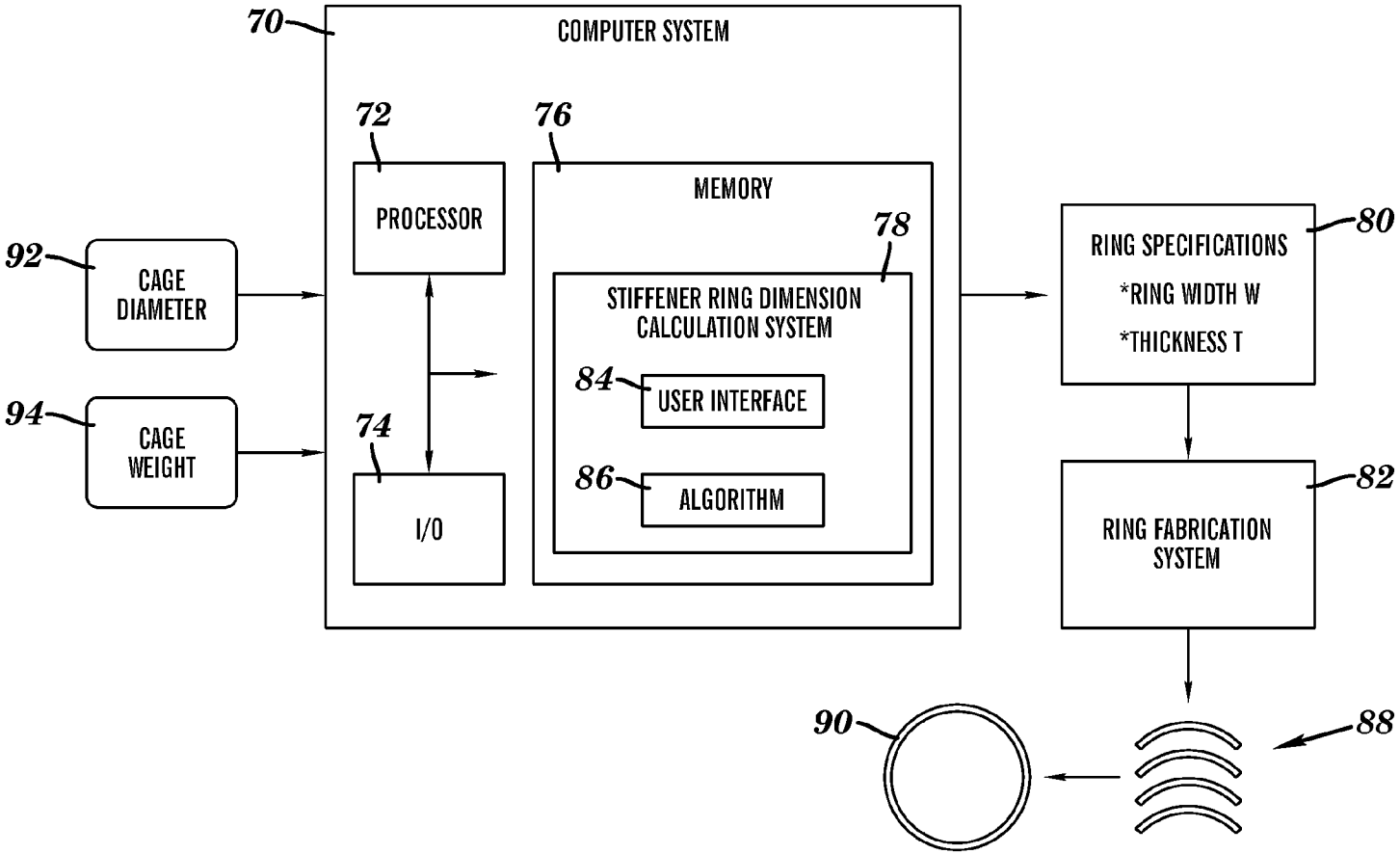
FIG. 6 depicts a computer system for calculating stiffener ring specifications in accordance with an embodiment of the present invention.

FIG. 6 depicts a computer system 70 for automating the calculation of these ring specifications 80 based on cage diameter 92 and cage weight 94. Computer system 70 includes a stiffener ring dimension calculation system 78, which may for example be implemented as a program product stored in memory 76 that can be executed by processor 72. Stiffener ring dimension calculation system 78 generally includes: (1) a user interface 84 that, e.g., allows a user to enter cage diameter 92 and cage weight 94; and (2) an algorithm 86 for calculating the ring specifications 80. An illustrative algorithm 86 is described in further detail with reference to FIGS. 7 and 8. Also shown in FIG. 6 is a ring fabrication system 82 that fabricates the stiffener ring based on the ring specifications 80, e.g., by cutting sections 88 from a steel sheet of the specified thickness. Once the sections 88 are cut, they can be welded together to form a final stiffener ring 90.

Figure 7:
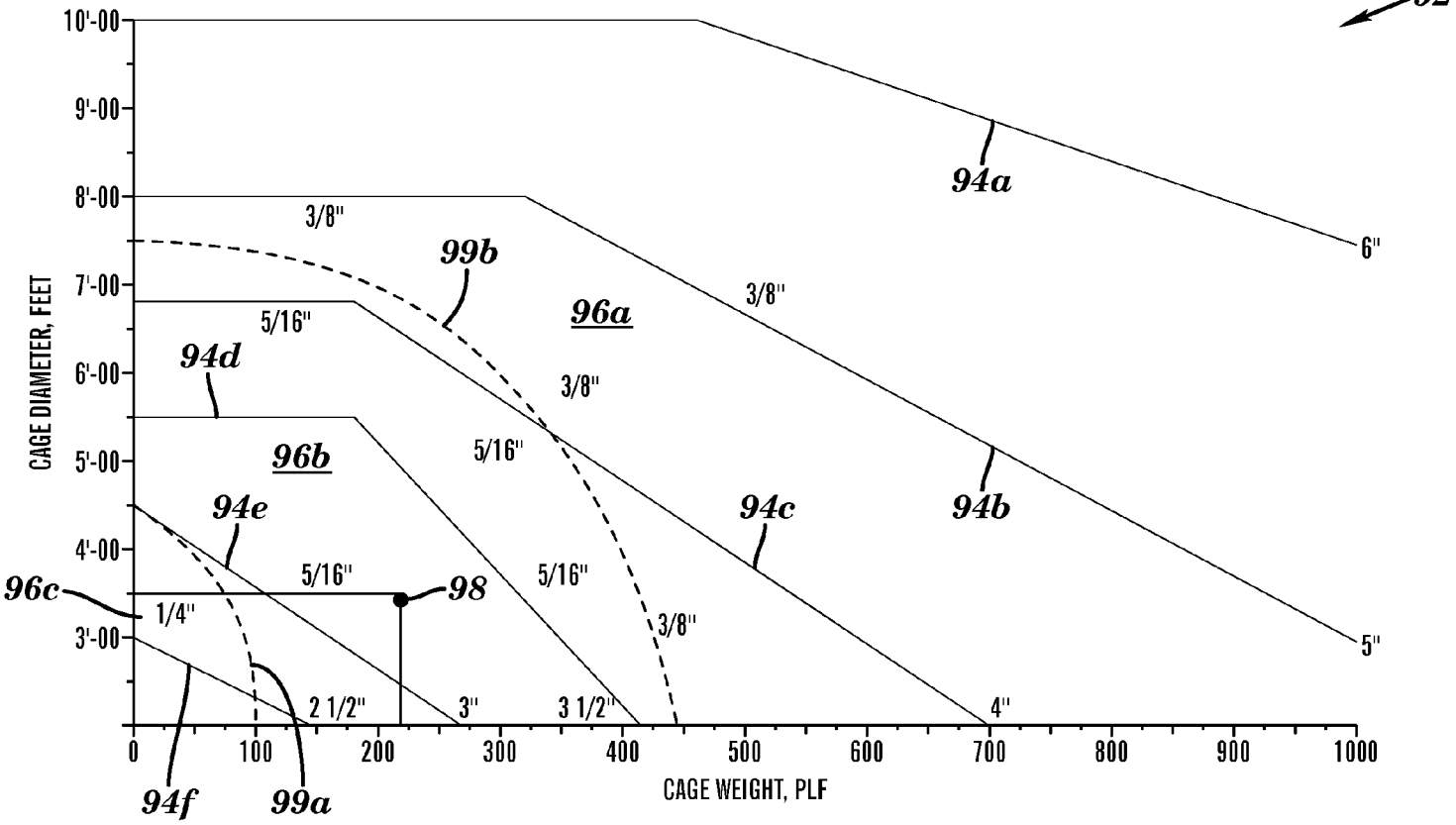
FIG. 7 depicts a nomograph in accordance with an embodiment of the present invention.
Figure 8:
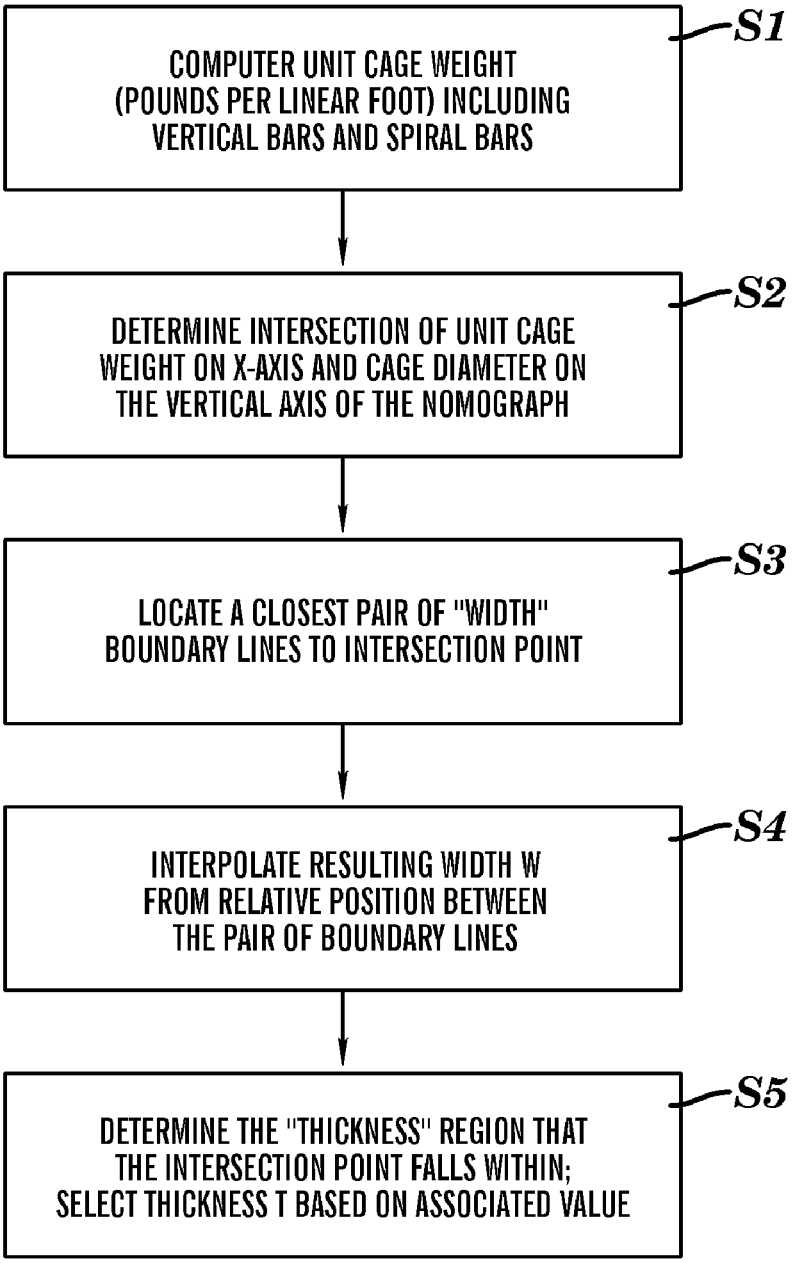
FIG. 8 depicts a flow chart for implementing an algorithm for calculating stiffener ring specifications in accordance with an embodiment of the present invention.

FIGS. 7 and 8 depict a nomograph 92 and flowchart, respectively, that describe an illustrative algorithm 86 for calculating thickness T and width W based on cage diameter and cage weight. As shown in FIG. 7, nomograph 92 includes a Y-axis that provides cage diameter in feet, and an X-axis that provides cage weight in pounds per linear foot (PLF). A given pair of inputs, e.g., a cage diameter of 3.5 feet and a cage weight of 215 pounds per linear foot provides an intersection point 98 within the nomograph 92. From the intersection point 98, a ring width W and ring thickness T can be determined. Ring width W is determined based on where the intersection point 98 falls with respect to a set of boundary values, in this embodiment, width boundary lines 94*a-f*. In this example, an intersection point 98 resides half way between the 3" boundary line 94*e* and the 3½" boundary line 94*d*. Interpolating that information results, e.g., in a 3¼" width. Ring thickness T is determined based on a region 96*a-c* the intersection point 98 falls in, as defined by dotted boundary lines 99*a-b*. Each region has an associated thickness T, e.g., ¼", 5/16", and ⅜". In this case, intersection point 98 falls in region 96*c*, which is associated with a ¼" thickness T.

FIG. 8 describes an illustrative methodology for determining thickness and width. At S1, compute cage weight in pounds per linear foot (PLF) including vertical (longitudinal) bars, spiral or hoops, (transverse) bars, instrumentation piping, etc. Next, at S2, determine the intersection point 98 of an inputted cage weight and cage diameter on nomograph 92. At S3, locate the closest pair of width boundary lines 94*a-f* to the intersection point 98 and at S4 determine a resulting width using interpolation. At, S5, determine the "thickness" region 96*a-c* that the intersection point 98 falls in, and select thickness based on associated value. It is understood that this described approach is meant to provide one illustrative embodiment for implementing an algorithm to select width W and thickness T for a given cage diameter and weight. Numerous variations could be employed and fall within the scope of the invention.

As will be appreciated by one skilled in the art, automated aspects of the present invention may take the form of a computer program product embodied in one or more computer readable medium(s) having computer readable program code embodied thereon. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A rebar cage, comprising:

a plurality of transversely mounted steel bars; and a plurality of stiffener rings that support the transversely mounted steel bars, wherein each stiffener ring includes:

a plurality of primary cutouts spaced about an exterior edge of the stiffener ring, wherein each primary cutout locates and secures one of the transversely mounted steel bars mounted therein; and a plurality of secondary cutouts spaced about an edge of the stiffener ring, wherein each of the secondary cutouts locates and secures an instrumentation pipe mounted therein.

2. The rebar cage of claim 1, wherein the primary cutouts include a U-shaped opening.

3. The rebar cage of claim 2, wherein the transversely mounted steel bars are secured in the plurality of primary cutouts using at least one of a wire, bolt and clamp.

4. The rebar cage of claim 1, wherein the secondary cutouts are spaced along an interior edge of each stiffener ring.

5. The rebar cage of claim 1, wherein each stiffener ring includes a set of mounting holes located proximate a secondary cutout.

6. The rebar cage of claim 5, further comprising a clamp that is inserted through the mounting hole to secure the instrumentation pipe.

7. The rebar cage of claim 1, wherein the primary cutouts comprise a double U-shaped opening that position and secure a bundle of transversely mounted steel bars.

8. The rebar cage of claim 1, wherein each stiffener ring further comprises a set of flow holes cut therein.

9. The rebar cage of claim 1, wherein approximately half of a cross-sectional area of each transversely mounted steel bar sits in the primary cutout and half extends outside the primary cutout.

* * * * *